US009131735B2

(12) United States Patent
Cavosie

(10) Patent No.: US 9,131,735 B2
(45) Date of Patent: Sep. 15, 2015

(54) HIGH BACK BODY SHAPER AND UNIVERSAL BRA ATTACHMENT

(76) Inventor: Tara J. Cavosie, Loudonville, NY (US)

( * ) Notice: Subject to any disclaimer, the term of this patent is extended or adjusted under 35 U.S.C. 154(b) by 352 days.

(21) Appl. No.: 13/034,926

(22) Filed: Feb. 25, 2011

(65) Prior Publication Data

US 2012/0142251 A1 Jun. 7, 2012

Related U.S. Application Data

(60) Provisional application No. 61/320,368, filed on Apr. 2, 2010.

(51) Int. Cl.

| | |
|---|---|
| ***A41C 3/00*** | (2006.01) |
| ***A41C 1/00*** | (2006.01) |
| ***A41C 1/02*** | (2006.01) |
| ***A41C 3/08*** | (2006.01) |
| *A41F 19/00* | (2006.01) |
| *A41C 1/06* | (2006.01) |

(52) U.S. Cl.

CPC . *A41C 1/003* (2013.01); *A41C 1/02* (2013.01); *A41C 3/08* (2013.01); *A41F 19/00* (2013.01); *A41C 1/06* (2013.01)

(58) Field of Classification Search

CPC .. A41C 3/0014; A41C 3/0021; A41C 3/0071; A41C 3/08; A41C 3/065

USPC ..... 450/30–33, 5, 7–9, 22, 81, 86; 2/67

See application file for complete search history.

(56) References Cited

U.S. PATENT DOCUMENTS

| | | | | |
|---|---|---|---|---|
| 1,632,137 | A * | 6/1927 | Jackson | 450/32 |
| 2,113,795 | A * | 4/1938 | Marshall | 2/73 |
| 2,654,091 | A * | 10/1953 | Nelson | 450/14 |
| 2,863,460 | A * | 12/1958 | Monroe | 450/11 |
| 3,212,503 | A * | 10/1965 | Gorman | 450/32 |
| 3,496,944 | A * | 2/1970 | Cuozzi | 450/104 |
| 3,577,993 | A * | 5/1971 | Gluckin et al. | 450/111 |
| 5,478,278 | A * | 12/1995 | Greenblatt | 450/32 |
| 5,667,422 | A * | 9/1997 | Erwin | 450/30 |
| 5,772,492 | A * | 6/1998 | Erwin | 450/30 |
| 6,000,993 | A * | 12/1999 | Erwin | 450/7 |
| 6,336,840 | B2 * | 1/2002 | Heroff | 450/30 |
| 6,443,805 | B1 * | 9/2002 | Kirkwood | 450/31 |
| 6,446,268 | B1 * | 9/2002 | Lazarian | 2/255 |
| 6,811,462 | B1 * | 11/2004 | Kenneally | 450/30 |
| 2007/0105481 | A1 * | 5/2007 | Scholz | 450/3 |

OTHER PUBLICATIONS http://www.leonisa.com/en/products/slimming-waist-cincher-shaper/?ColorSelectionId=72 retrieved on Jul. 15, 2014.

* cited by examiner

*Primary Examiner* — Gloria Hale

(74) *Attorney, Agent, or Firm* — One LLP

(57) ABSTRACT

An undergarment is intended to be worn by a user in combination with a brassiere having a back band. The undergarment comprises a unitary body piece having an inside, an outside, a front, a back, opposing sides, a top portion and a bottom portion, each defined by their relative positions when worn by the user. The undergarment further comprises at least one fastener adjacent the top portion and operable to removably engage the brassiere adjacent the back band such that the back of the user is not visible between the back band and the top portion.

7 Claims, 24 Drawing Sheets

HIGH BACK BODY SHAPER AND UNIVERSAL BRA ATTACHMENT

CROSS-REFERENCE TO RELATED APPLICATION

This application claims priority to U.S. Prov. Pat. Appl. No. 60/320,368, filed on Apr. 2, 2010, the entire contents and disclosure of which is herein incorporated by reference.

FIELD OF THE INVENTION

In general, the present invention provides an interchangeable cup, bra, and body shaper. Specifically, the present invention provides high back body shaper and universal bra attachment

BACKGROUND OF THE INVENTION

As fashion trends continue to change at an accelerated pace, undergarment design is becoming a growing concern. Specifically, undergarments that hide lines and hardware, such as clips, etc., while providing adjustability, remain absent from the marketplace.

SUMMARY OF THE INVENTION

In general, the present invention relates to a high back body shaper and universal bra attachment. Specifically, the present invention provides a body shaper having an optional high back and optional crotch flap/closure. The body shaper can have or accommodate any type of (universal) attachment mechanism that allows for attachment of any type of bra. In a typical embodiment, the attachment mechanism comprises a set (at least one) of clips that discretely clip to the bra of a wearer. When the two articles are attached, the attachment mechanisms are hidden. In addition, no gap is present between the band of the bra (e.g., the band around the back of the wearer) and the body shaper when the two are attached. This type of attachment is referred to herein as a gapless connection/intersection. The gapless attachment minimizes lines, prevents unsightly skin bulges, and prevents the body shaper from sliding down the back of a wearer.

A first aspect of the present invention provides a body shaper, comprising a back portion and an attachment mechanism for attaching an upper portion of the back portion to a bra, the attachment resulting in a gapless union of the bra to the back portion.

A second aspect of the present invention provides a method of connecting a body shaper to a bra, comprising donning the bra and the body shaper, which comprises a back portion; and connecting the upper portion of the back portion of the body shaper to the bra with an attachment mechanism to create a gapless union between the bra and the body shaper.

An additional aspect of the present invention provides a body shaper, comprising a back, a front and sides; and a substantially hidden connection mechanism used for joining the body shaper to at least one of a band of a bra and a strap of a bra, the joining resulting in a gapless union between the bra and the body shaper.

BRIEF DESCRIPTION OF THE DRAWINGS

These and other features of this invention will be more readily understood from the following detailed description of the various aspects of the invention taken in conjunction with the accompanying drawings in which.

Figure 1:
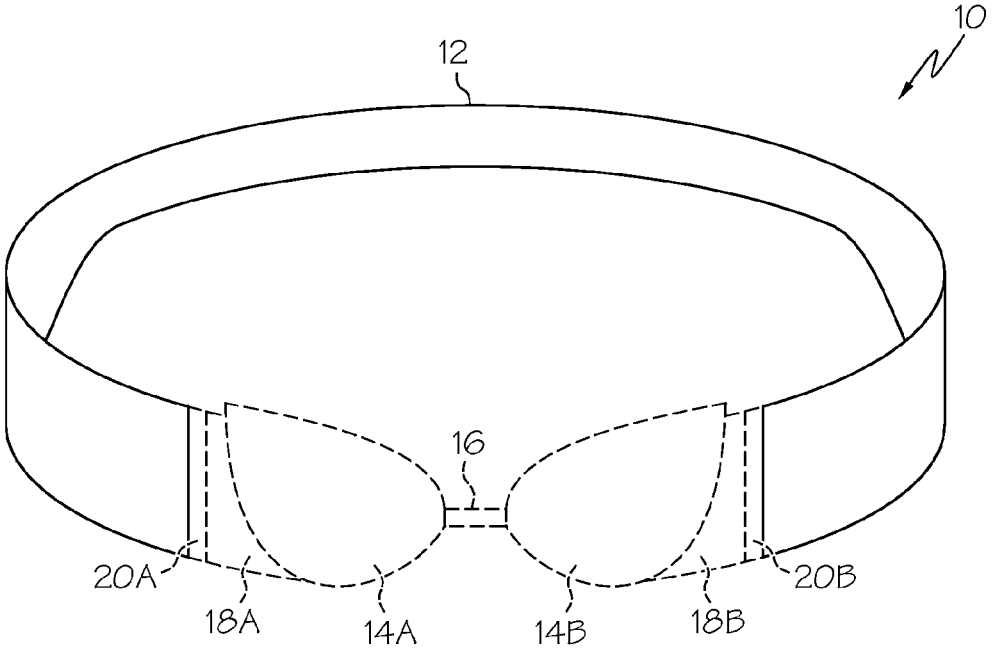
FIG. 1 shows a band connection bra having a connector adaptor according to an embodiment of the present invention.

The drawings are not necessarily to scale. The drawings are merely schematic representations, not intended to portray specific parameters of the invention. The drawings are intended to depict only typical embodiments of the invention, and therefore should not be considered as limiting the scope of the invention. In the drawings, like numbering represents like elements.

DETAILED DESCRIPTION OF THE INVENTION

As indicated above, the present invention relates to a high back body shaper and universal bra attachment. Specifically, the present invention provides a body shaper having an optional high back and optional crotch closure. The body shaper can have or accommodate any type of (universal) attachment mechanism that allows for attachment of any type of bra. In a typical embodiment, the attachment mechanism comprises a set (at least one) of clips that discretely clip to the bra of a wearer. When the two articles are attached, the attachment mechanisms are hidden. In addition, no gap is present between the band of the bra (e.g., the band around the back of the wearer) and the body shaper when the two are attached. This type of attachment is referred to herein as a gapless connection/intersection. The gapless attachment minimizes lines and prevents unsightly skin bulges, and prevents the body shaper from sliding down the back of a wearer.

Referring now to FIG. 1, a band connection bra 10 having optional connector adaptors 18A-B according to an embodiment of the present invention is shown. As further shown, bra 10 comprises band 12 and (detachable) cups 14A-B joined together via bridge connector or bridge 16 (which can be any mechanism for connecting cups now known or later developed). Under the present invention, cups 14A-B can be directly coupled to band 12, or can be connected via connector adapters 18A-B.

Regardless, the union/connection points 20A-B located between (outer edges of) cups 14A-B (and connector adapters 18A-B if used) and (edges of) band 12 on bra 10 will be substantially seamless, and made using any means now known or later developed. In one embodiment of the invention, no hardware will be visible on either the inside or outside of bra 10, so that band 12, connector adapters 18A-B, and cups 14A-B will appear as if they are a unitary article. Different ways of achieving such coupling/joining of these components will be discussed in conjunction with FIGS. 13-16 below. Along these lines, it is understood that cups 14A-B, connector adapters 18A-B, and band 12 are all separately detachable under the present invention. That is, cups 14A-B can be detached from band 12 and connector adapters 18A-B (if used). In addition, connector adapters 18A-B can also be detachable from cups 14A-B and band 12. To this end, band 12, cups 14A-B, and connector adapters 18A-B, can be two or more separate articles. This provides plug-and-playability for these components. For example, a wearer could decide to use only cups 14A-B and band 12, or the wearer could decide to use cups 14A-B, connector adapters 18A-B and band 12. Still yet, cups 14A-B can be replaced individually or as a single unit. To this extent, bridge connector 16 is also detachable from both cups 14A-B. Still yet, connector adapters 18A-B can be a continuation (non-detachable) of band 12 and/or cups 14A-B.

It should be understood that the terms inner edge, outer edge, etc., may be used herein simply as a point of reference. To this extent, it is understood that they may change based on the point of view of a viewer.

FIGS. 2-12 show bras having varying cup shapes/configurations in accordance with the present invention. It should be noted in advance that FIGS. 2-12 (as well as FIGS. 17-19) do not show connector adapters 18A-B for brevity purposes only. To this extent, it is understood that connector adapters 18A-B can be implemented in conjunction with any of the bras depicted herein from FIGS. 1-21 within the scope of the present invention. In addition, it is understood that the bras of FIGS. 2-12 share all of the same features/advantages (e.g., detachability of components, seamless unions, etc.) of bra 10 of FIG. 1. However, depending on the particular cup configuration, bridge connector 16 may be provided, may be eliminated, or may be very subtle (e.g., be provided via stitching cups together). Examples of a bridge connector 16 can include, but are not limited to the following: snaps, hook and eye, clips, stitching, etc.

Figure 2:
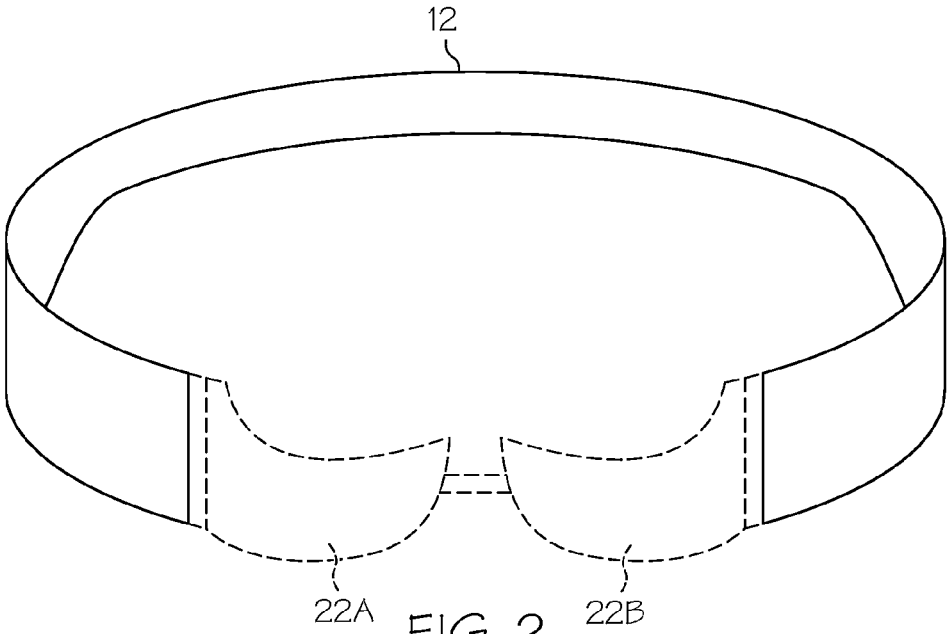
FIG. 2 shows the bra of FIG. 1 having Balconette or Demi Cups according to an embodiment of the present invention.

In any event, FIGS. 2-12 each show bras as follows:

FIG. 2 shows the bra of FIG. 1 having Balconette or Demi Cups 22A-B according to an embodiment of the present invention.

Figure 3:
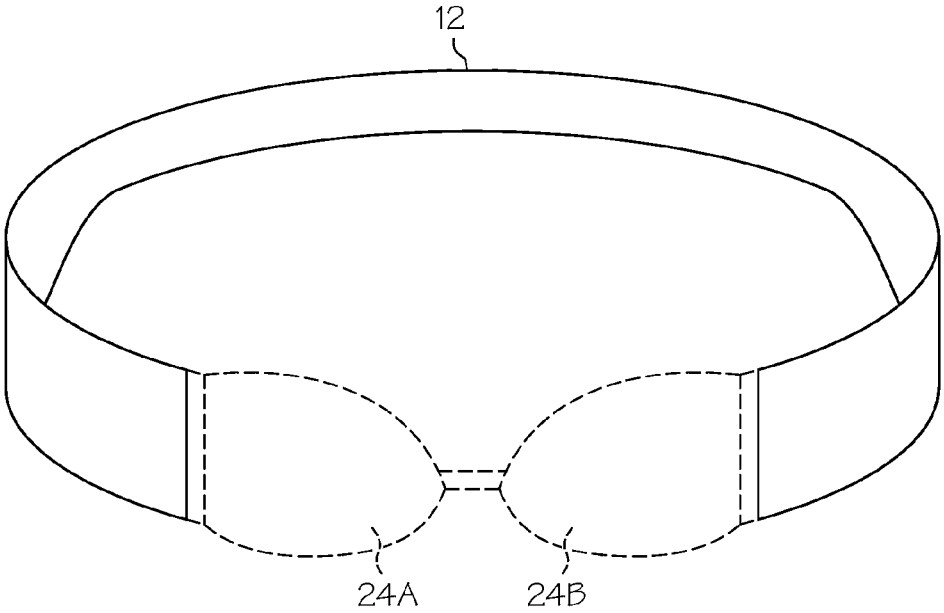
FIG. 3 shows the bra of FIG. 1 having Bandeau Cups according to an embodiment of the present invention.

FIG. 3 shows the bra of FIG. 1 having Bandeau Cups 24A-B according to an embodiment of the present invention.

Figure 4:
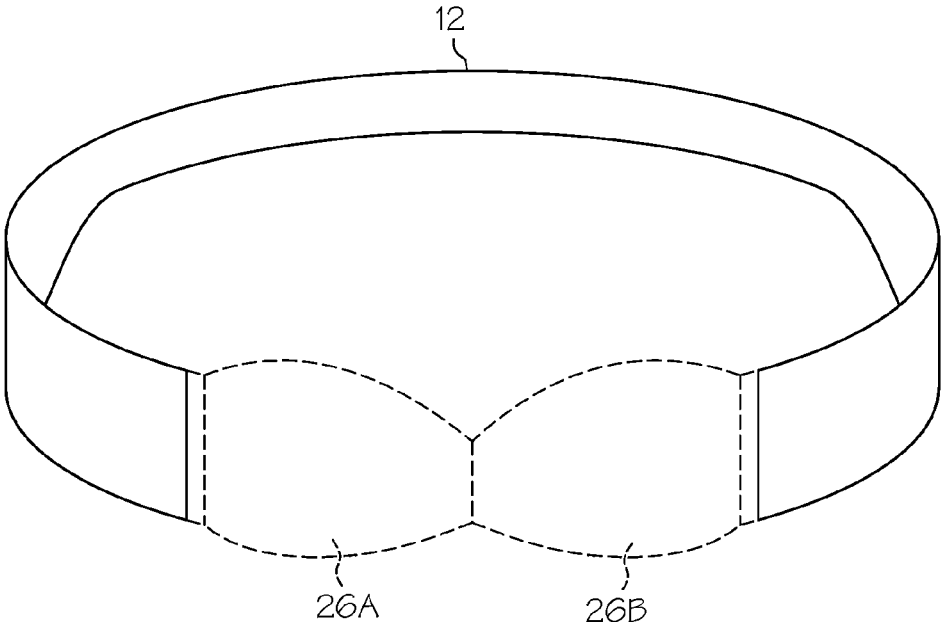
FIG. 4 shows the bra of FIG. 1 having Bandeau Cups with a seamless front closure according to an embodiment of the present invention.

FIG. 4 shows the bra of FIG. 1 having Bandeau Cups 26A-B with a seamless front closure according to an embodiment of the present invention.

Figure 5:
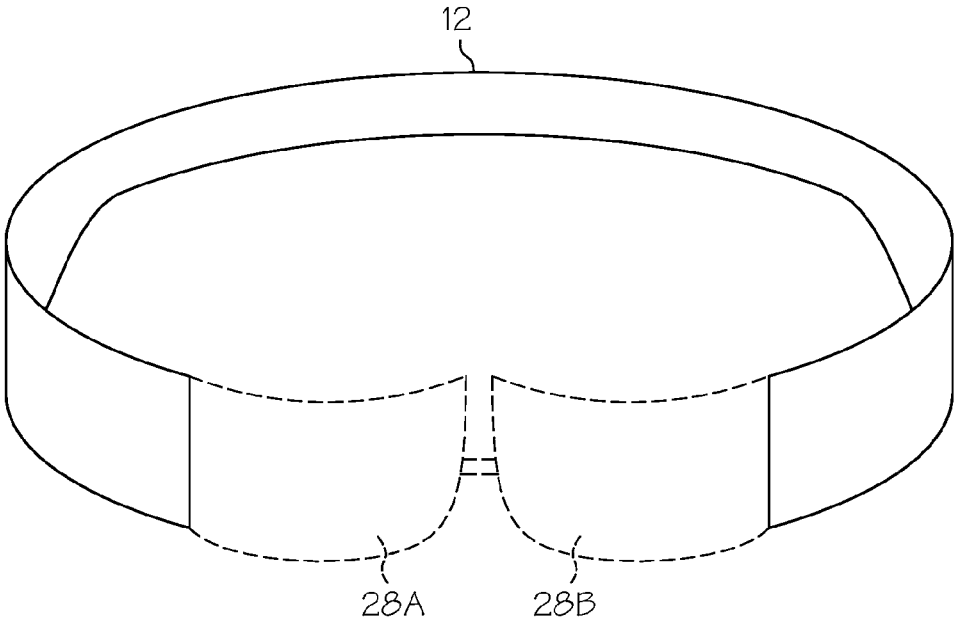
FIG. 5 shows the bra of FIG. 1 having Full Cups according to an embodiment of the present invention.

FIG. 5 shows the bra of FIG. 1 having Full Cups 28A-B according to an embodiment of the present invention.

Figure 6:
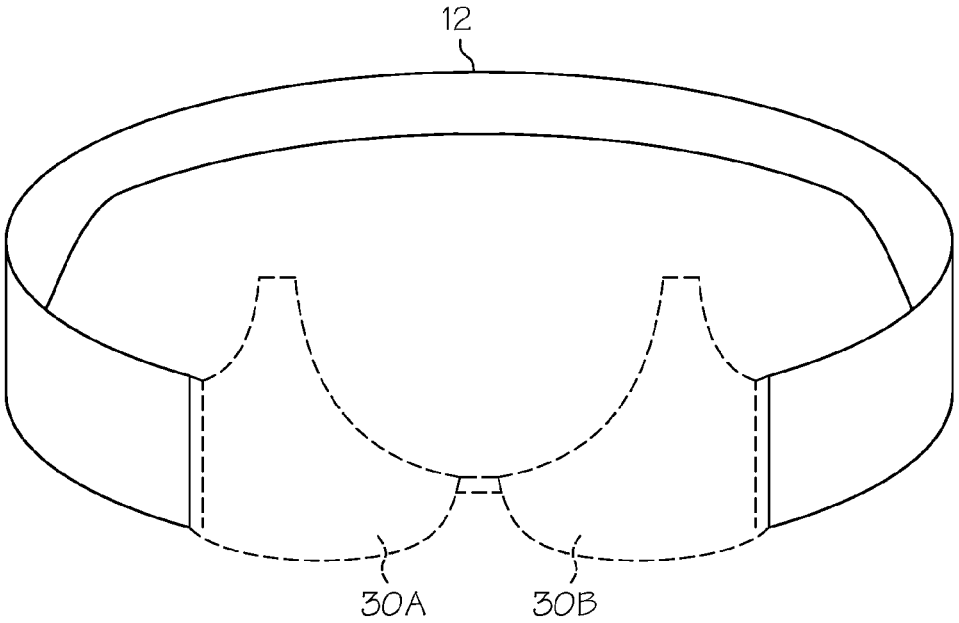
FIG. 6 shows the bra of FIG. 1 having Plunge Cups according to an embodiment of the present invention.

FIG. 6 shows the bra of FIG. 1 having Plunge Cups 30A-B according to an embodiment of the present invention.

Figure 7:
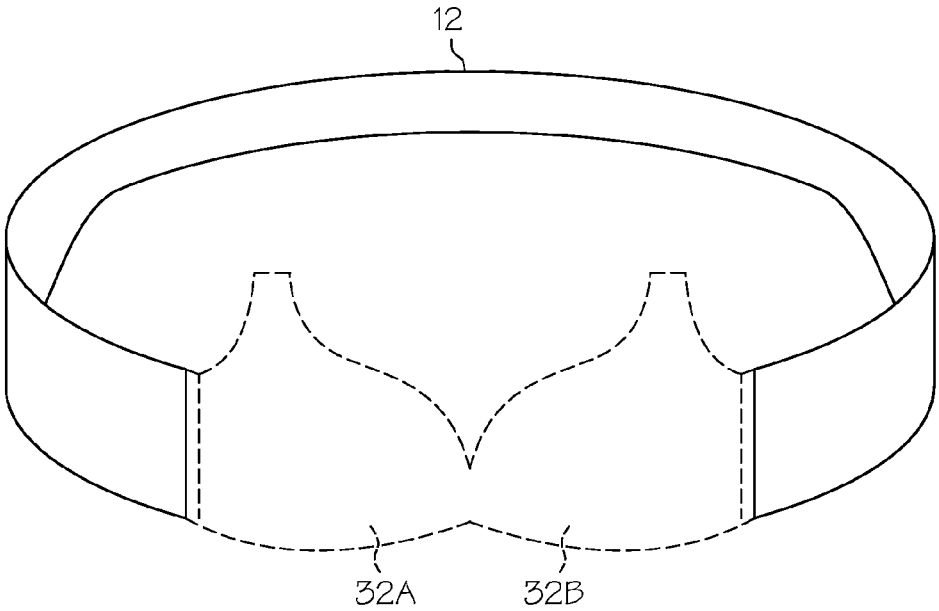
FIG. 7 shows the bra of FIG. 1 having Push-Up Cups according to an embodiment of the present invention.

FIG. 7 shows the bra of FIG. 1 having Push-Up Cups 32A-B according to an embodiment of the present invention.

Figure 8:
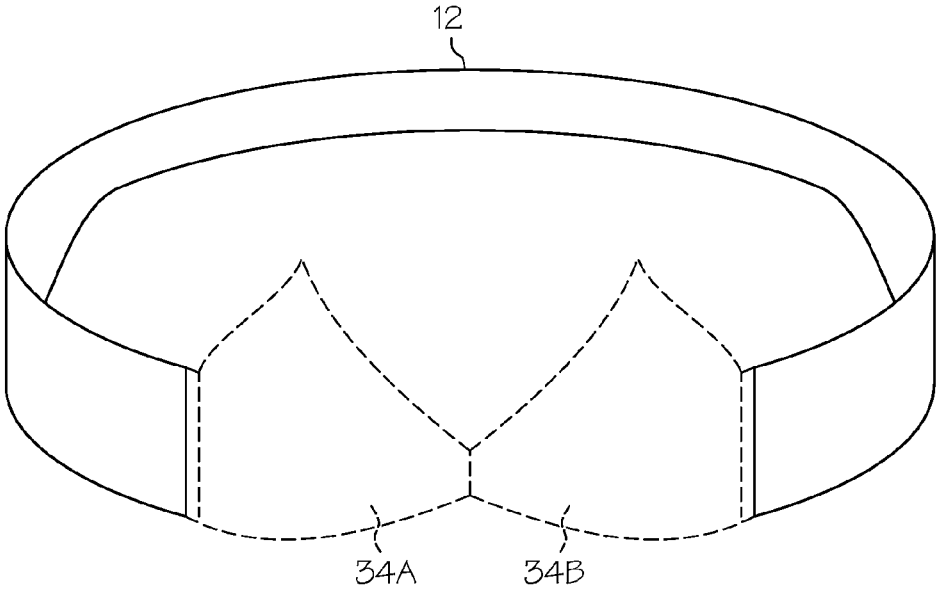
FIG. 8 shows the bra of FIG. 1 having Triangle Cups according to an embodiment of the present invention.

FIG. 8 shows the bra of FIG. 1 having Triangle Cups 34A-B according to an embodiment of the present invention.

Figure 9:
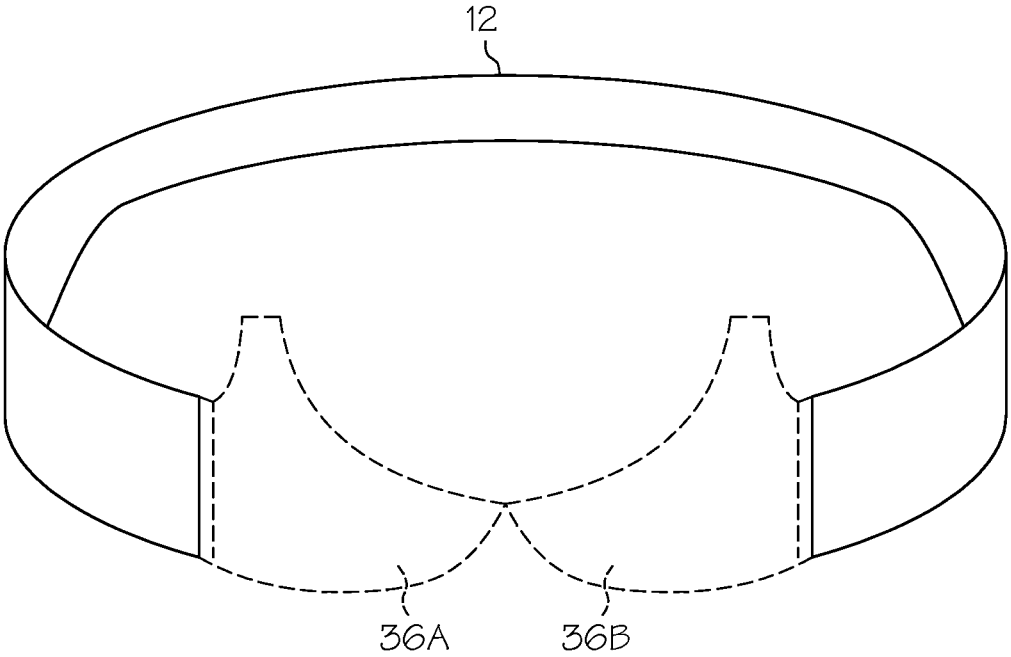
FIG. 9 shows the bra of FIG. 1 having Scoop Neck Cups according to an embodiment of the present invention.

FIG. 9 shows the bra of FIG. 1 having Scoop Neck Cups 36A-B according to an embodiment of the present invention.

Figure 10:
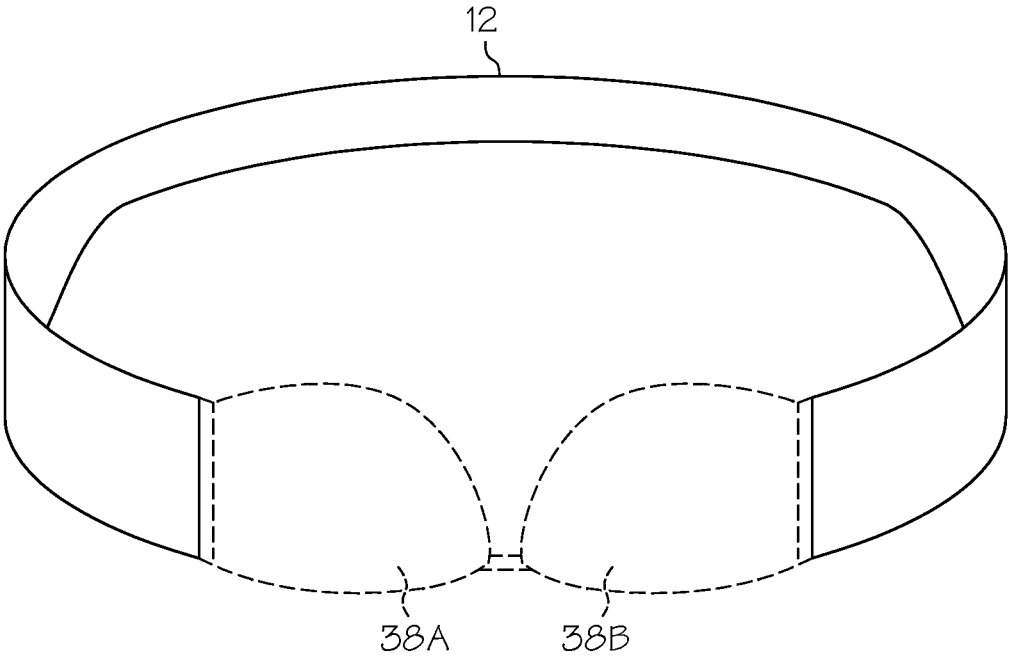
FIG. 10 shows the bra of FIG. 1 having Deep Plunge Cups according to an embodiment of the present invention.

FIG. 10 shows the bra of FIG. 1 having Deep Plunge Cups 38A-B according to an embodiment of the present invention.

Figure 11:
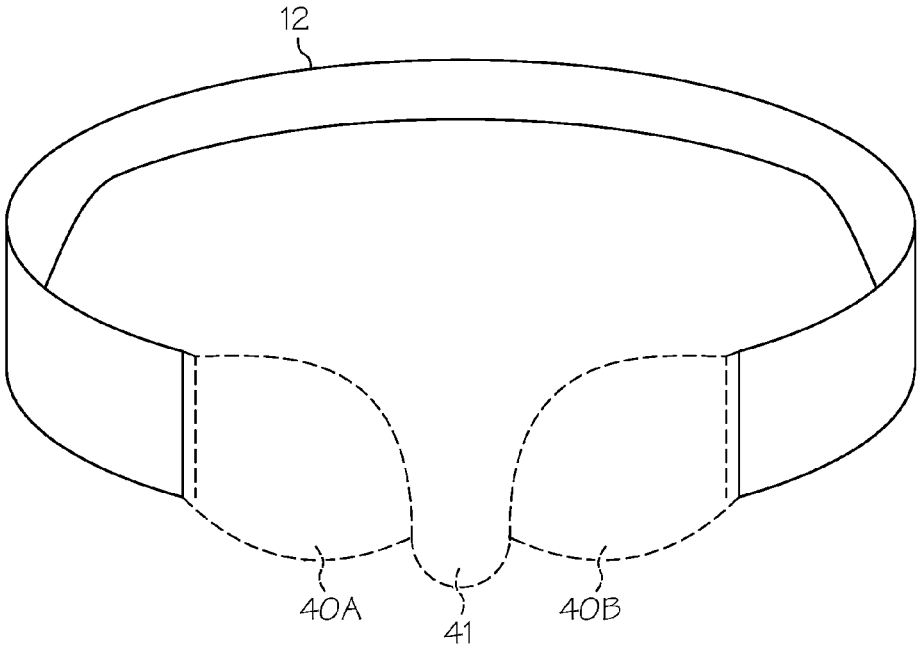
FIG. 11 shows the bra of FIG. 1 having U-Shaped Plunge bridge connector according to an embodiment of the present invention.

FIG. 11 shows the bra of FIG. 1 having a U-Shaped Plunge bridge connector 41 and Cups 40A-B according to an embodiment of the present invention.

Figure 12:
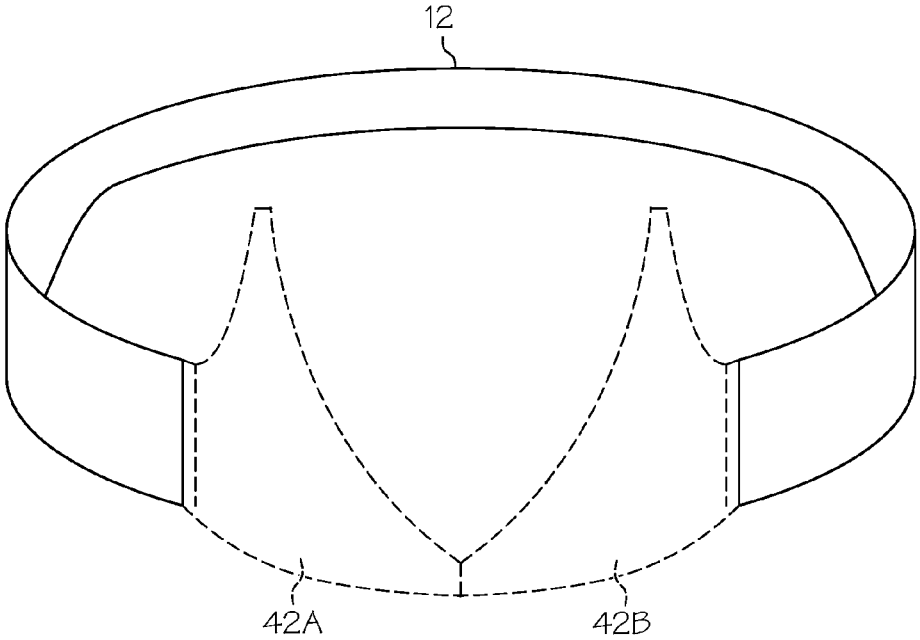
FIG. 12 shows the bra of FIG. 1 having other Plunge Style Cups according to an embodiment of the present invention.

FIG. 12 shows the bra of FIG. 1 having other Plunge Style Cups 42A-B according to an embodiment of the present invention.

Figure 13:
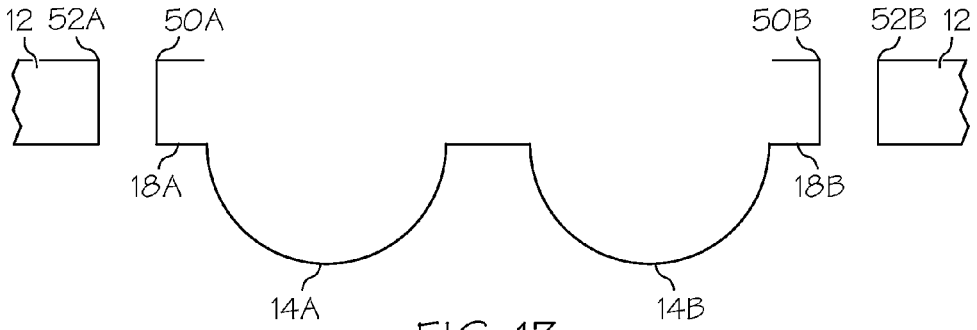
FIG. 13 shows an aerial view of the bra of FIG. 1 having a surface mounted connection position according to an embodiment of the present invention.

Referring now to FIGS. 13-16, the manner in which cups (or connector adapters) and band are seamlessly interconnected will be described in greater detail. FIG. 13 shows a more precise view of the connection. As depicted, edges 50A-B of cups 14A-B couple (i.e., join, connect, etc.) to edges 52A-B of band 12 (at least indirectly) to create an appearance of a substantially seamless connection when set of cups 14A-B are coupled to band 12. In general, such union is achieved via any method now known or later developed such as a hook and eye approach in which one or more sets of hooks and eyes (of any size) are utilized. The hooks and eyes in FIG. 13 are preferably surface mounted along edges 50A-B and 52A-B. It should be understood that as used herein, the term "couple" could mean a direct coupling so that edges 52A-B of band 12 can abut edges 50A-B of cups 14A-B, or an indirect coupling so that direct abutment is not present. In the case of the latter, a small space could be present even though edges 50A-B and 52A-B are coupled to one another via connection mechanisms 60A-B.

Figure 14:
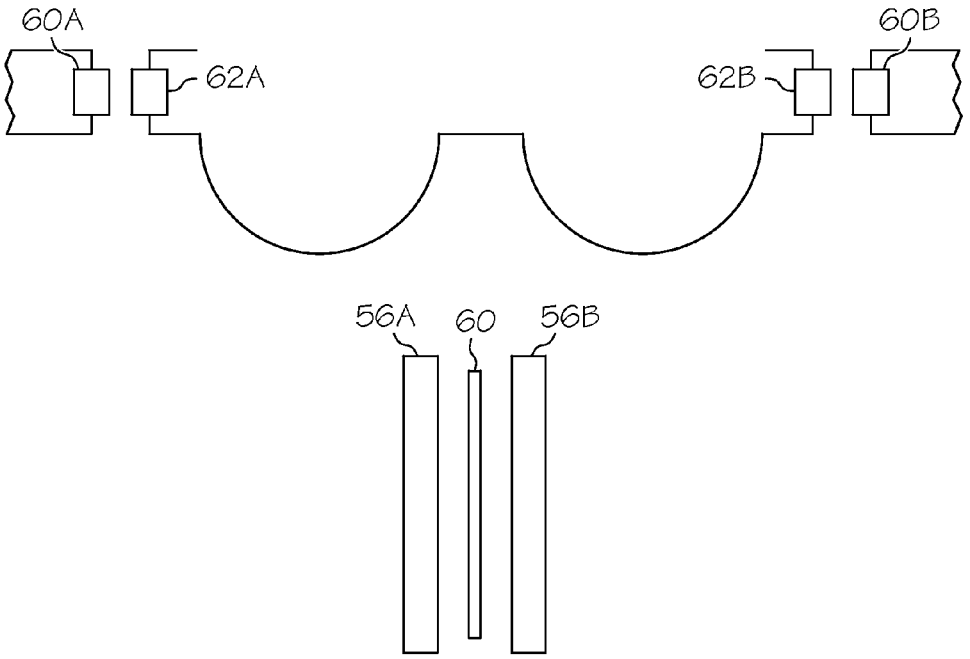
FIG. 14 shows an aerial view of the bra of FIG. 1 having a partially recessed/partially protruding connection position according to an embodiment of the present invention.
Figure 15:
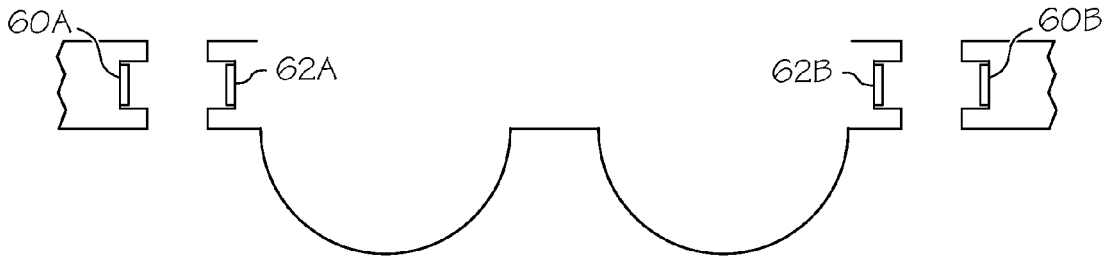
FIG. 15 shows an aerial view of the bra of FIG. 1 having a fully recessed connection position according to an embodiment of the present invention.
Figure 16:
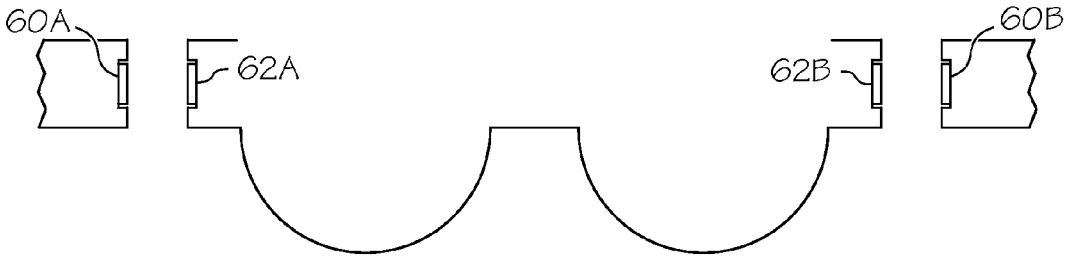
FIG. 16 shows an aerial view of the bra of FIG. 1 having a recessed flush mount connection position according to an embodiment of the present invention.

There are various ways of implementing this approach without losing the sandwich or seamless union. For example, FIG. 14 shows a bra of FIG. 1 having connection mechanisms 60A-B positioned in part recessed/part protruding connection positions according to an embodiment of the present invention. FIG. 15 shows the bra of FIG. 1 having connection mechanisms 60A-B and 62A-B positioned in fully recessed connection positions according to an embodiment of the present invention, such that connection mechanisms 60A-B and 62A-B are hidden when cups 14A-B are coupled to band 12. FIG. 16 shows the bra of FIG. 1 having connection mechanisms 60A-B and 62A-B positioned in recessed flush mounted connection positions according to an embodiment of the present invention. The hooks and eyes in FIGS. 14, 15 and 16 are preferably deployed between the multiple layers of fabric that make up cups 14A-B (connector adapters 18A-B) and band 12. That is, the hooks and eyes are sandwiched between the fabric layers so that they are hidden and do not contact any other garment or the wearer itself. This is shown in greater detail in FIG. 14 in which a connection mechanism 60 (e.g., either a hook or an eye) is disposed between a first layer of fabric 56A of the bra and a second layer of fabric 56B of the bra, wherein the first layer of fabric 56A of the bra is in contact with a wearer (not shown) of the bra, and wherein the second layer of fabric of the bra 56B is in contact with a garment (not shown) worn by the wearer of the bra. As used herein, the first layer of fabric 56A can (does not have to) comprise an innermost layer of fabric disposed on cups 14A-B and an innermost layer of fabric of band 12, while the second layer of fabric of the bra 56B comprises an outermost layer of fabric of cups 14A-B and an outermost layer of fabric of band 12. It should be appreciated that bra 10 may have additional layers of fabric between the innermost and outermost layers of the bra and is not limited by this description. Furthermore, it will be appreciated that the present invention is not limited by the location of connection mechanism 60, as the hooks and eyes may be located in any number of different locations on the bra, as will be further described below.

Figure 17:
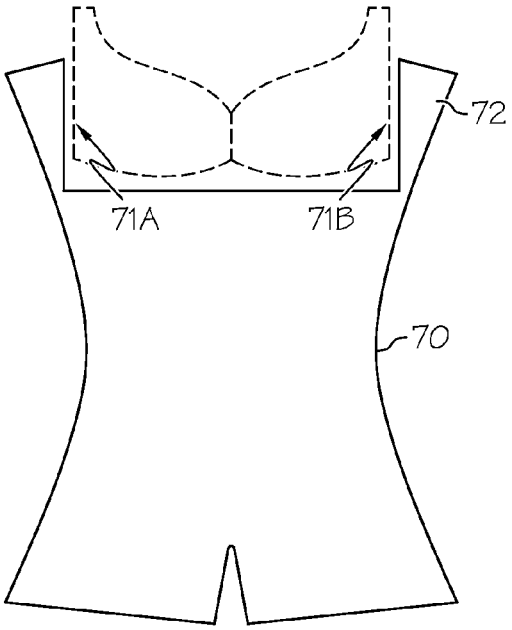
FIG. 17 shows a body shaper/bra combination according to an embodiment of the present invention.
Figure 18:
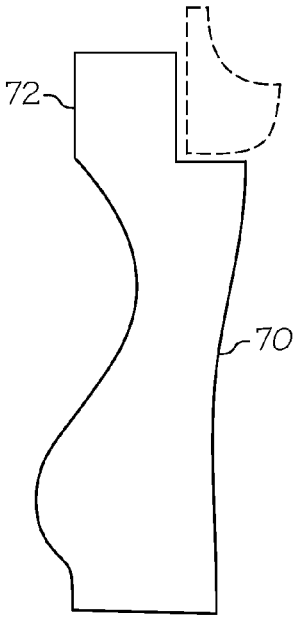
FIG. 18 shows a side view of a body shaper/bra combination according to an embodiment of the present invention.
Figure 19:
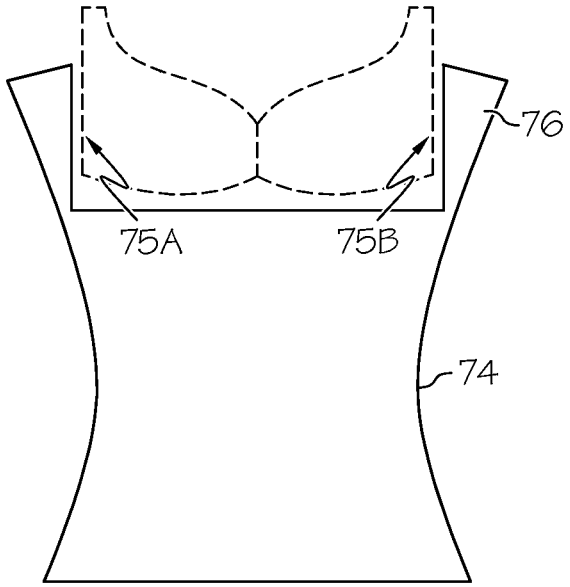
FIG. 19 shows a front and side view of a body shaper/bra combination having an upper body shaper according to an embodiment of the present invention.
Figure 19:
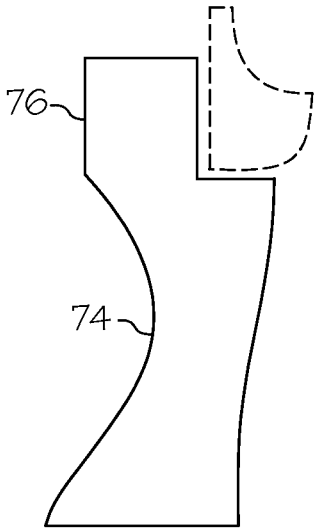

FIGS. 17-19 show that any of the components (e.g., cups connectors) of FIGS. 1-16 and FIGS. 20-21 can be used in conjunction with a body shaper developed under the present invention. For example, FIGS. 17 and 18 show front and side views, respectively, of a full body shaper 70 (e.g., torso to thighs, torso to feet, and/or anything in between) that can be releasably attached to cups 14A-B. In this embodiment, body shaper 70 has an attachment portion 72 so that it can be attached to cups 14A-B. The edges 71A-B of attachment portion 72 couple to edges 50A-B of cups 14A-B to create the appearance of a substantially seamless connection. This attachment can be accomplished using any attachment mechanism now known or later developed such as the hook and eye approach discussed herein. FIG. 19 shows an upper body version (e.g., torso) of a body shaper 74. Similar to body shaper 70 of FIGS. 17-18, body shaper 74 has attachment portion 76 so that it can be releasably attached to cups 14A-B. The edges 75A-75B of attachment portion 76 couple to edges 50A-B of cups 14A-B to create the appearance of a substantially seamless connection. The attachment can be accomplished using any attachment mechanism now known or later developed such as the hook and eye approach discussed herein. Furthermore, it is understood that connector adapters 18A-B discussed above can be implemented in conjunction with any of the cups and body shapers depicted in FIGS. 17-19 within the scope of the present invention.

Figure 20:
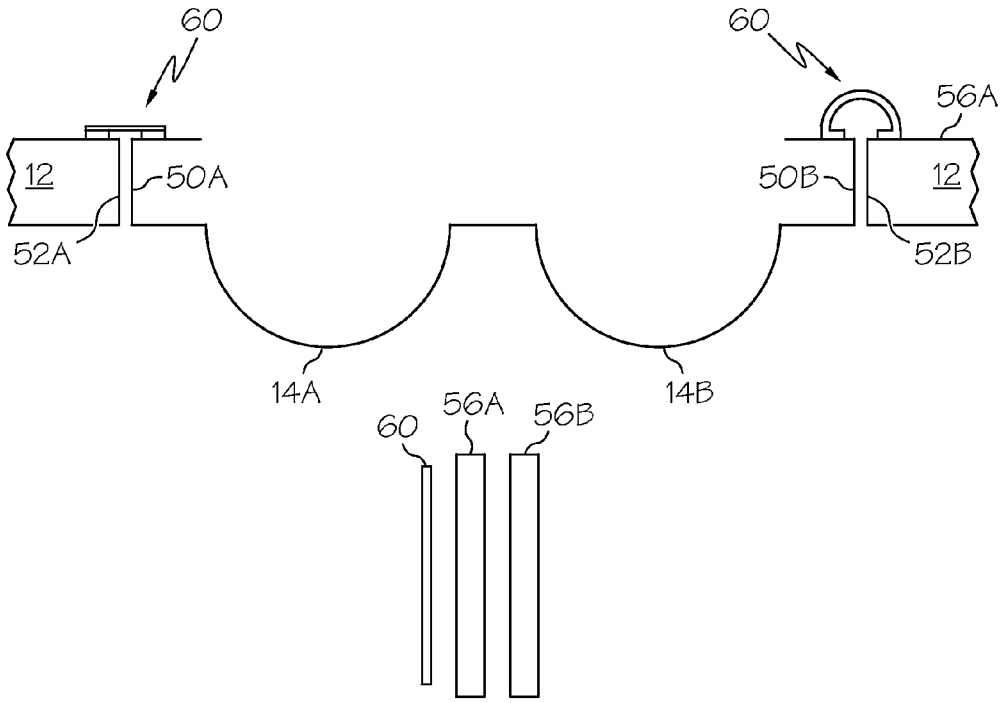
FIG. 20 shows a top and side view of a bra and connection mechanism disposed on a first layer of fabric of the bra according to an embodiment of the present invention.
Figure 21:
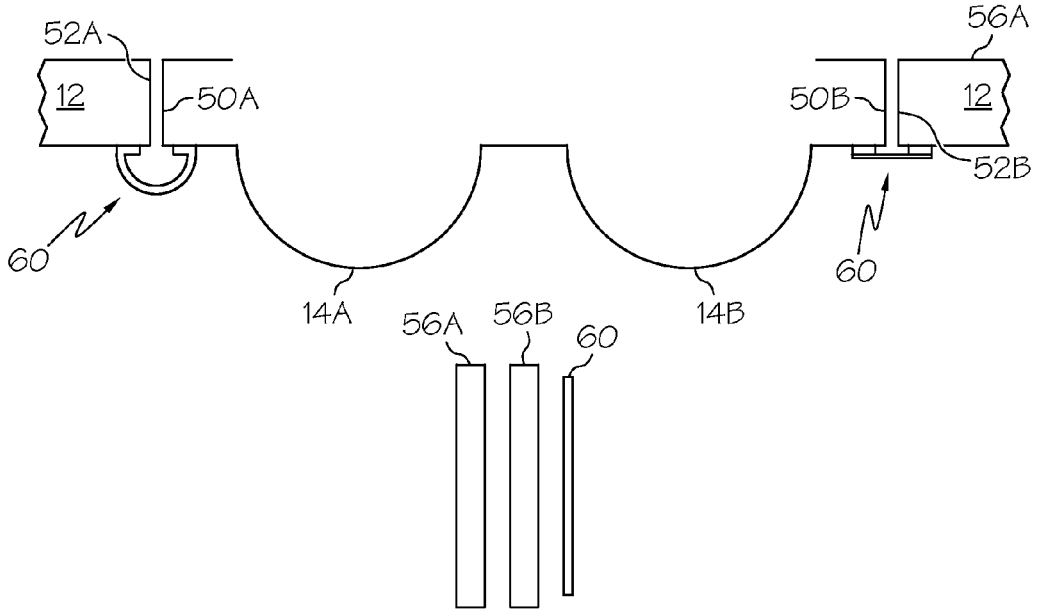
FIG. 21 shows a top and side view of a bra and connection mechanism disposed on a second layer of fabric of the bra according to an embodiment of the present invention.

FIGS. 20-21 illustrate additional configurations for connecting cups 14A-B to band 12, while maintaining couplement between the edges of the band and the edges of each of the cups. For example, FIG. 20 shows a bra of FIG. 1 having connection mechanism 60 comprising at least one set of hooks and eyes disposed on the first layer of fabric 56A in contact with the wearer of the bra. Alternatively, as shown in FIG. 21, connection mechanism 60 comprises at least one set of hooks and eyes disposed on the second layer of fabric 56B of the bra in contact with a garment worn by the wearer of the bra. It will be appreciated that various connection mechanisms and/or configurations for creating the appearance of a substantially seamless connection when edges of the band 52A-B couple edges of the cups 50A-B are possible within the scope of the present invention. For example, in yet another embodiment, connection mechanism 60 may be disposed on both first and second layers of fabric 56A-56B.

As indicated above, the present invention relates to a high back body shaper and universal bra attachment. Specifically, the present invention provides a body shaper having an optional high back and optional crotch closure. The body shaper can have or accommodate any type of (universal) attachment mechanism that allows for attachment of any type of bra. In a typical embodiment, the attachment mechanism comprises a set (at least one) of clips that discretely clip to the bra of a wearer. When the two articles are attached, the attachment mechanisms are hidden. In addition, no gap is present between the band of the bra (e.g., the band around the back of the wearer) and the body shaper when the two are attached. This type of attachment is referred to herein as a gapless connection/intersection. The gapless attachment minimizes lines and prevents unsightly skin bulges, and prevents the body shaper from sliding down the back of a wearer.

Figure 22:
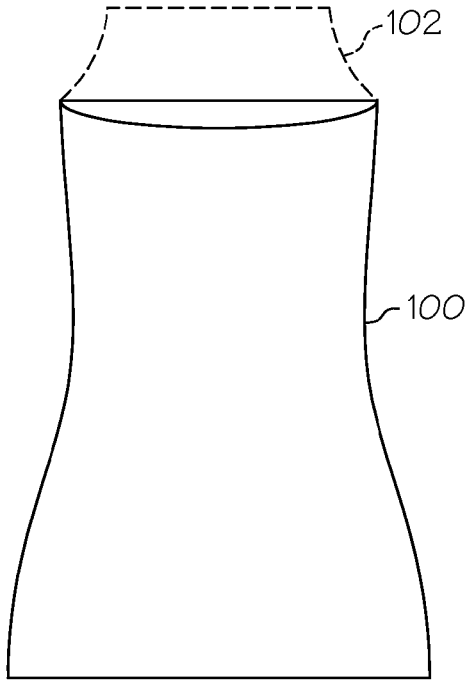
FIG. 22 shows a slip style high back body shaper according to an embodiment of the present invention.
Figure 23:
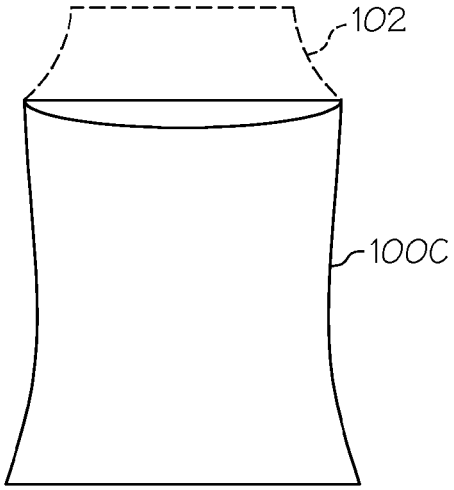
FIG. 23 shows a waist style high back body shaper according to an embodiment of the present invention.
Figure 24:
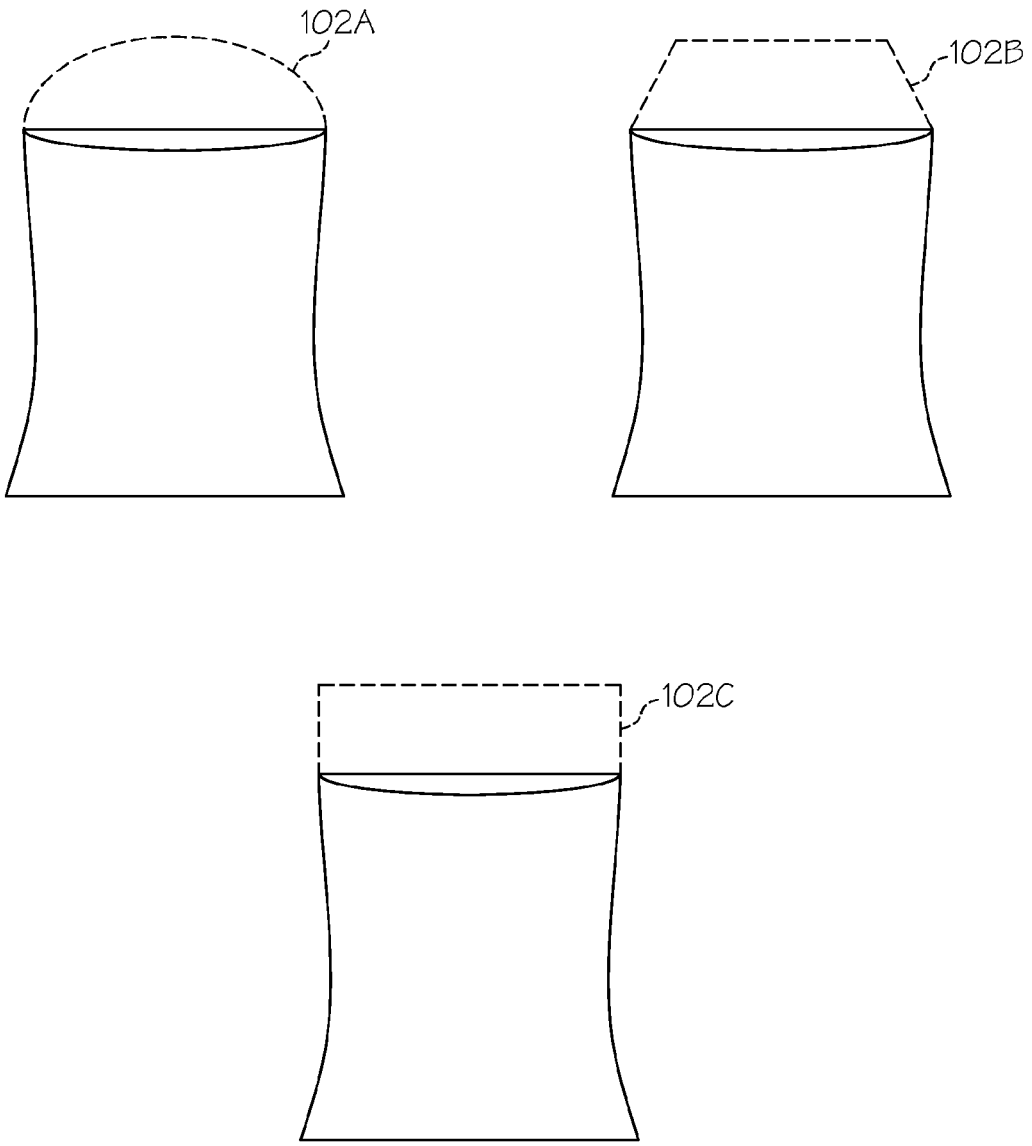
FIG. 24 shows different high back shapes according to an embodiment of the present invention.
Figure 25:
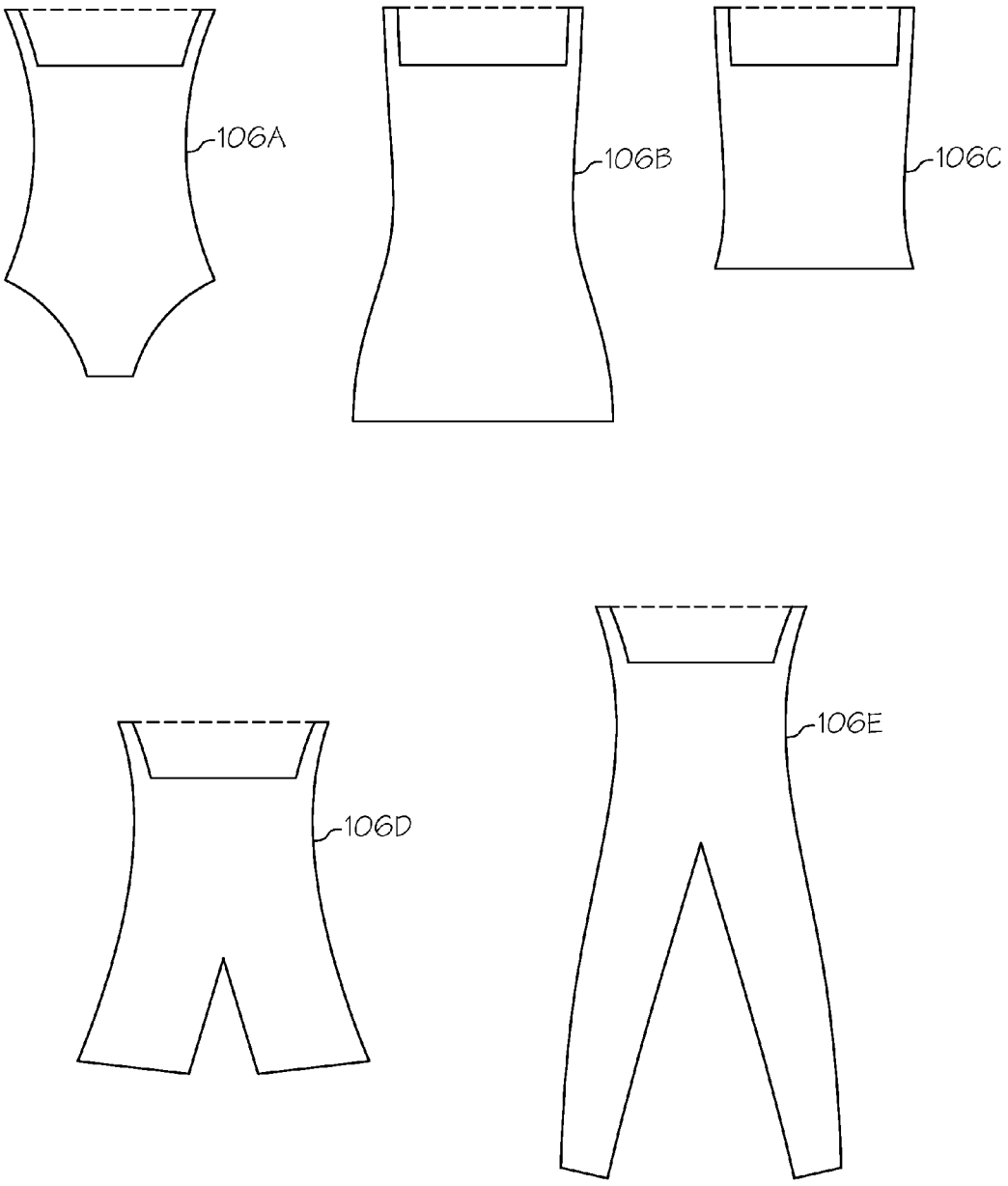
FIG. 25 shows different shaped body shapers according to an embodiment of the present invention.
Figure 26:
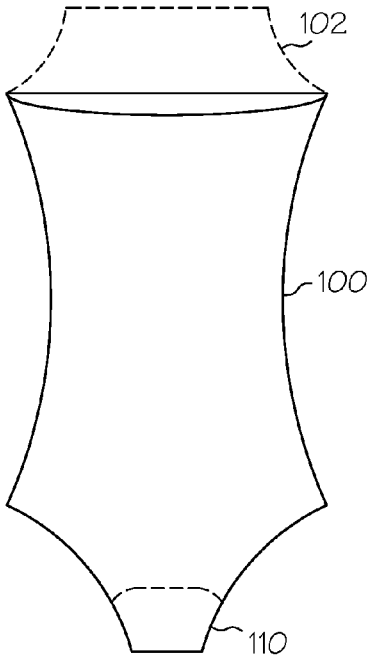
FIG. 26 shows a high back body shaper having a crotch flap according to an embodiment of the present invention.
Figure 27:
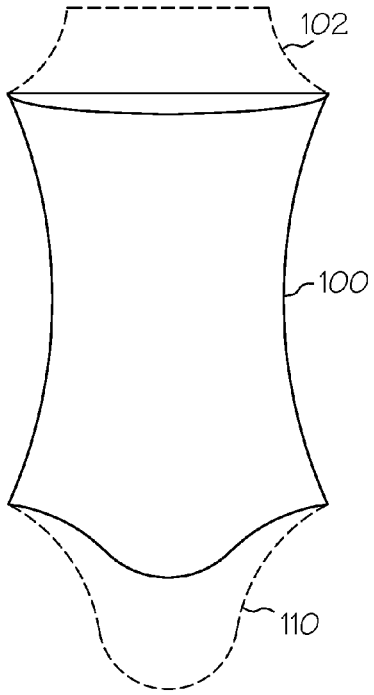
FIG. 27 shows a high back body shaper having a crotch flap in an open position according to an embodiment of the present invention.
Figure 28:
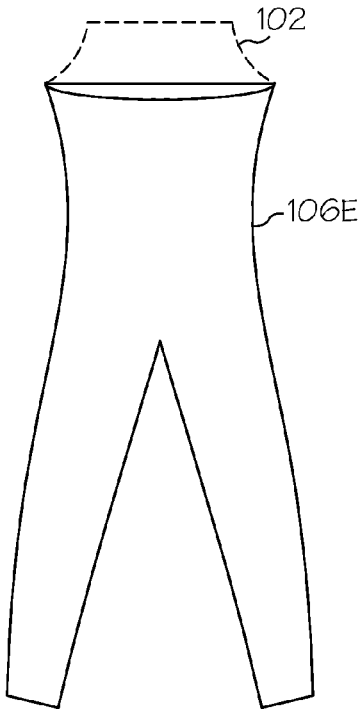
FIG. 28 shows a high back body shaper in full leg style according to an embodiment of the present invention.
Figure 29:
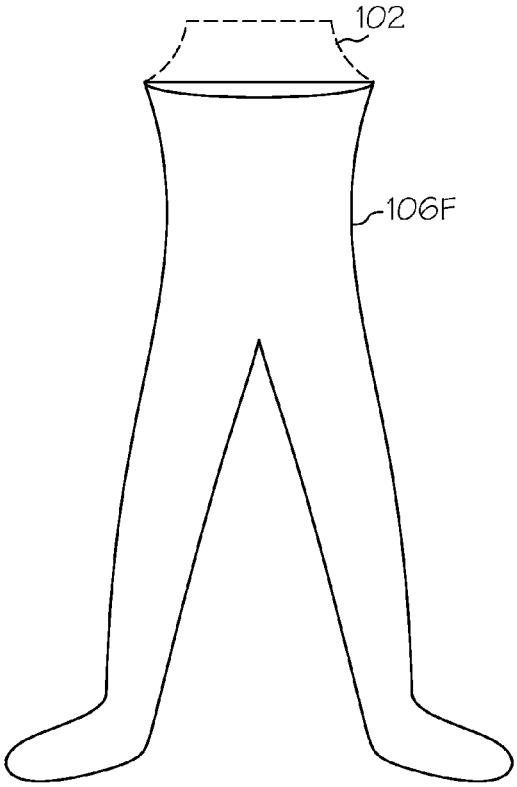
FIG. 29 shows a high back body shaper in a closed foot panty hose style according to an embodiment of the present invention.
Figure 30:
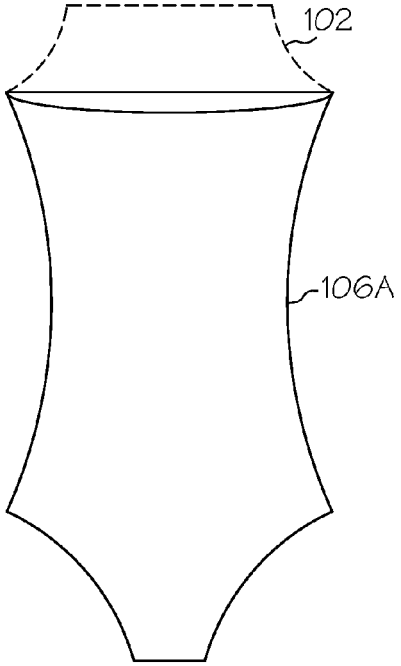
FIG. 30 shows a high back body shaper in panty style according to an embodiment of the present invention.
Figure 31:
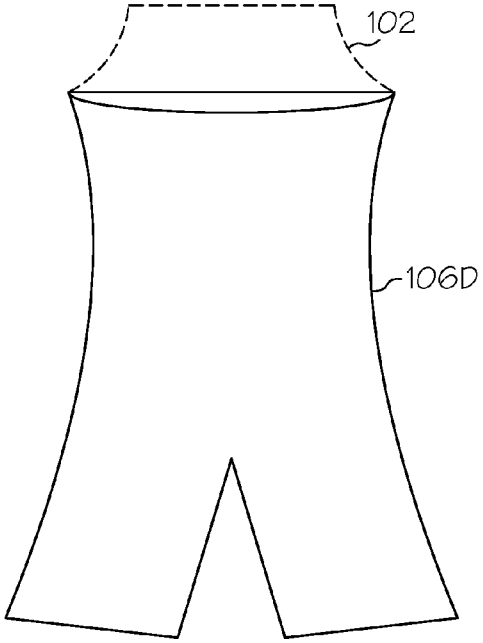
FIG. 31 shows a high back body shaper in short style according to an embodiment of the present invention.

FIG. 22 shows a slip style body shaper 100 having a high back 102. FIG. 23 shows a waist style high back body shaper 100C having a high back 102 according to an embodiment of the present invention. FIG. 24 shows different high back shapes 102A-C (which could be used on any style or shape body shaper) according to an embodiment of the present invention. FIG. 25 shows different shaped body shapers 106A-E according to an embodiment of the present invention, including panty style 106A, slip style 106B, waist style 106C, short style 106D, and full leg style 106E shapers. FIG. 26 shows a high back body shaper 100 having a crotch flap 110 according to an embodiment of the present invention. The crotch flap can be used in conjunction with any style or shape body shaper, or with any style or shape high back. FIG. 27 shows a high back body shaper 100 having a crotch flap 110 in an open position according to an embodiment of the present invention. FIG. 28 shows a high back body shaper in full leg style 106E according to an embodiment of the present invention. FIG. 29 shows a high back body shaper in a closed foot panty hose style 106F according to an embodiment of the present invention. FIG. 30 shows a high back body shaper in panty style 106A according to an embodiment of the present invention. FIG. 31 shows a high back body shaper in short style 106D according to an embodiment of the present invention.

Figure 32:
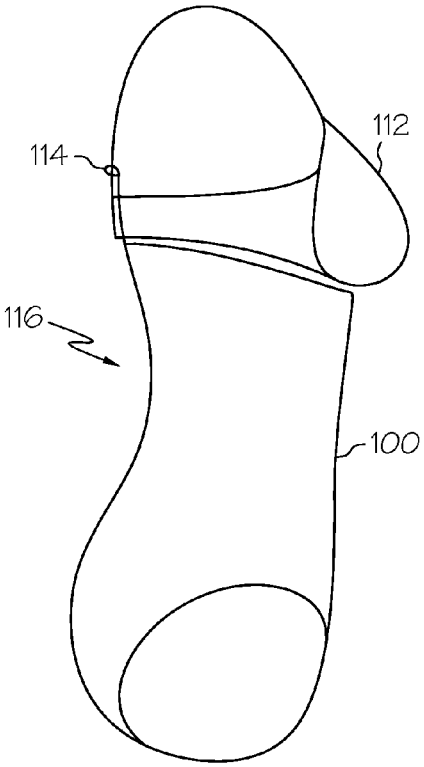
FIG. 32 shows a side view of high back body shaper and bra with a universal attachment/connection mechanism according to an embodiment of the present invention.

FIG. 32 shows a side view of high back body shaper 100 and bra 112 with a universal attachment/connection mechanism 114 according to an embodiment of the present invention. It is understood that any style body shaper 100 and/or high back described herein could be used in conjunction with any type of bra. Those shown in FIG. 32 are shown for illustrative purposes only. In any event, attachment mechanism 114 allows any style bra to be attached to any style and/or shape body shaper 100. As can be seen in FIG. 32, when bra 112 is attached to body shaper 100 via a connection mechanism 114, no gap is present between bra 112 and body shaper 100. This is especially useful around the back 116 of a wearer so that no lines, unsightly skin bulges exist, or body shaper 100 slippage occur. Thus, the present invention provides a gapless union of a body shaper and bra around the back of the wearer.

Figure 33:
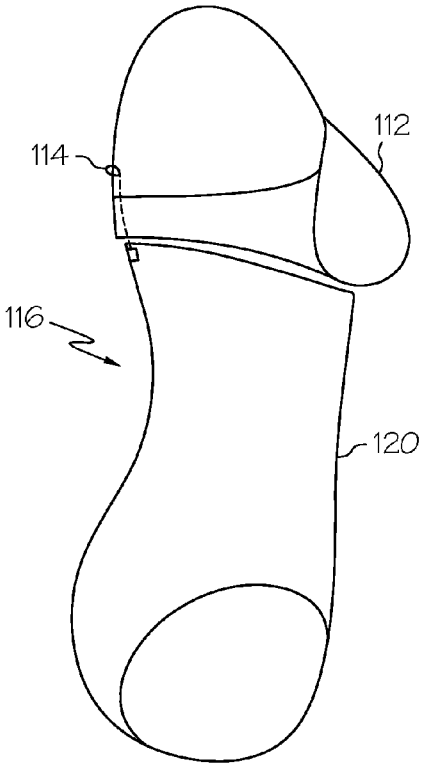
FIG. 33 shows a side view of a regular back body shaper and bra with a universal attachment/connection mechanism according to an embodiment of the present invention.

FIG. 33 shows a side view of a regular back body shaper 120 and bra 112 with a universal attachment/connection mechanism 114 according to an embodiment of the present invention. This figure demonstrates that a high back is not necessary to have a gapless union between a bra 112 and a body shaper 120.

Figure 34:
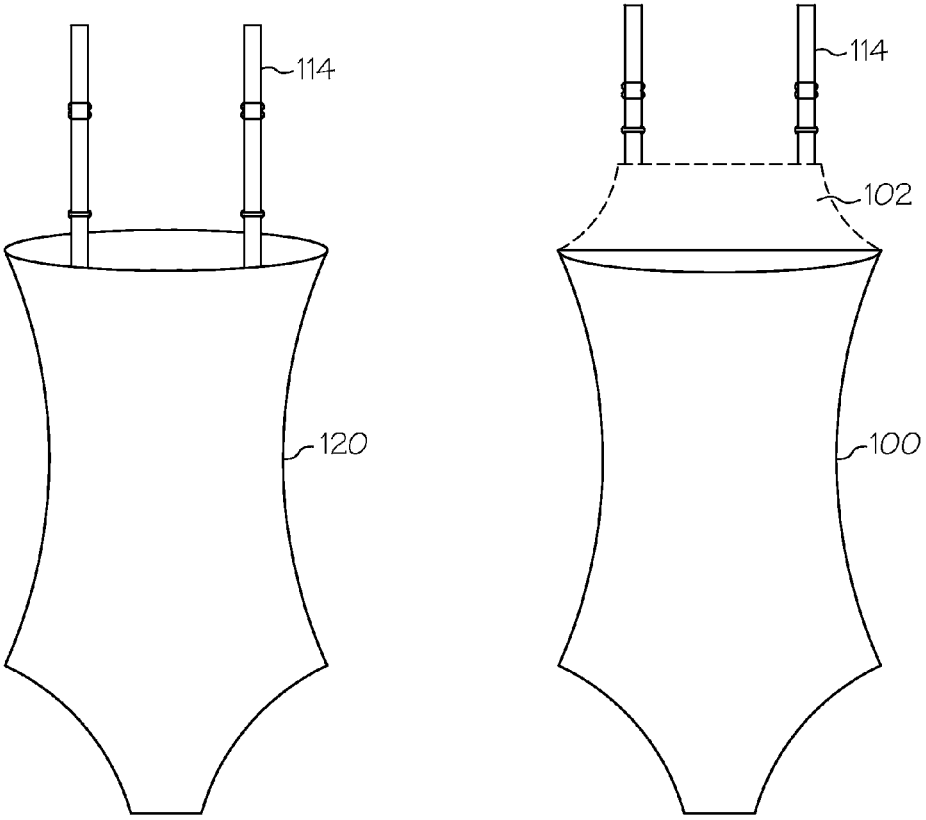
FIG. 34 shows front views of the body shapers and bras with universal attachment/connection mechanisms according to an embodiment of the present invention.

FIG. 34 shows front views of body shapers 100 (with high back 102) and 120 (a traditional body shaper) with universal attachment/connection mechanisms 114 according to an embodiment of the present invention. In general, attachment mechanisms 114 can be any type of attachment mechanisms such as adhesives, Velcro, hooks and eyes, clips, buttons, snaps, straps, and combinations thereof. In a typical embodiment, the attached mechanism 114 will attach/join a top portion of the body shaper to either the straps and/or the back of the bra. Moreover, attachment mechanisms 114 can be mounted on the body shaper for attachment to a bra, or as an independent unit that is detachable from the both body shaper and/or the bra. In one embodiment, attachment mechanism 114 is mounted on high back 102 of high back body shaper 100. In another embodiment, attachment mechanism 114 connects to a traditional body shaper 120. Regardless, attachment mechanisms 114 will have any length necessary to cause the attachment of a body shaper to a bra in a gapless fashion. In addition, attachment mechanisms 114 should be positioned so that they fall in line with traditional placement of existing bra straps so that no additional lines are present (e.g., the attachment mechanisms 114 are hidden) and for ease of attachment.

Figure 35:
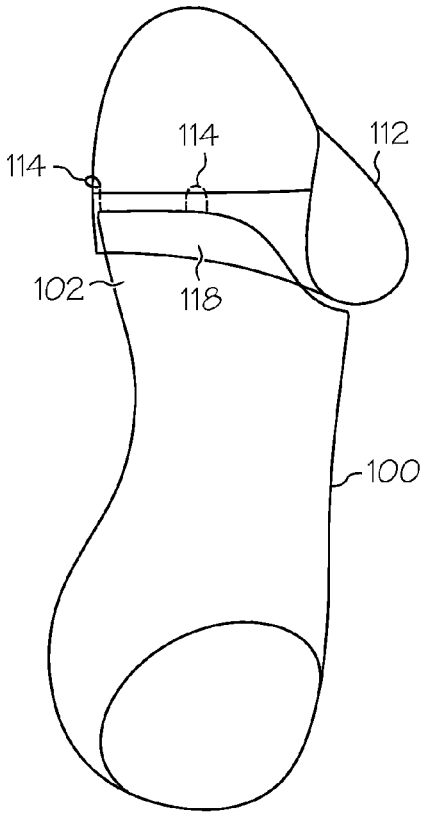
FIG. 35 shows a side view of a high back body shaper with optional high sides and bra with multiple universal attachment/connection mechanism according to an embodiment of the present invention.

FIG. 35 shows a side view of a high back body shaper 100 with optional high sides 118 and bra 112 with multiple universal attachment/connection mechanism 114 according to an embodiment of the present invention. In addition to or apart from the high back 102, optional high sides 118 on the left and right of the body provide connection surfaces between bra 112 and body shaper 100 that allow body shaper 100 to be coupled to bra 112 with mechanism of attachment/connection 114 being concealed from external view. The front of body shaper 100 remains at a regular level below the bra, by comparison. Connections and attachments of body shaper 100 to the bra band may be made anywhere along the band, and may include: near the back of the bra band, under the arm, and near the cup of the bra. Attachment/connection mechanism(s) 114 will have one or more positions along the high back 102 and optional high sides 118 of body shaper 100. Various attachment/connection mechanisms 114 may also be optionally detachable or removable. Connections and attachments should be understood to include one or more connections or attachments which are substantially hidden from view.

Figure 36:
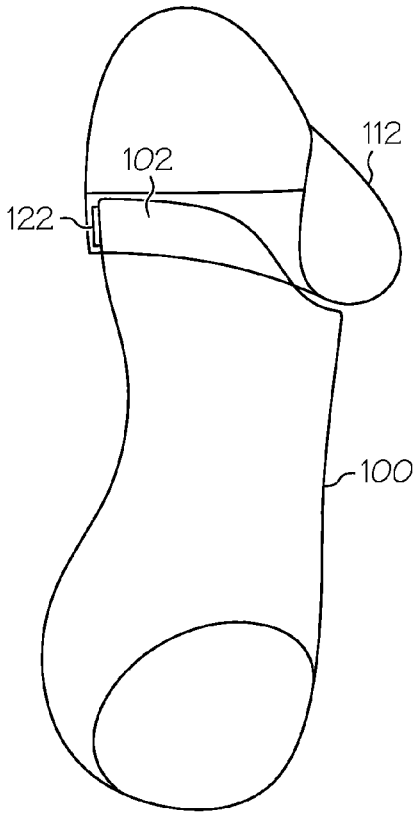
FIG. 36 shows a side view of a high back body shaper and bra with an attachment/connection mechanism according to an embodiment of the present invention.

FIG. 36 shows a side view of a high back body shaper 100 and bra 112 with an attachment/connection mechanism 122 according to an embodiment of the present invention. High back body shaper 100 connects with bra 112 where the back band of the bra 112 overlaps the high back 102 of the body shaper. Located within this overlap is attachment/connection mechanism 122 which comprises a no-slip material, such as silicone. The no-slip material is disposed between the fabrics of body shaper 100 and bra 112. Some no-slip material is joined to at least one of bra 112 and body shaper 100 to create a no-slip surface, and in some embodiments both. In one embodiment, attachment/connection mechanism 122 is a silicone edge on high back 102 of body shaper 100, which faces away from the wearer when the garment is worn. This silicone edge comes in contact with the back band of the wearer's bra (which lays over high back 102) and remains unseen when bra 112 and body shaper 100 are worn together. The silicone edge prevents the back of the body shaper from slipping down the wearer's back while the garment is in use.

Figure 37:
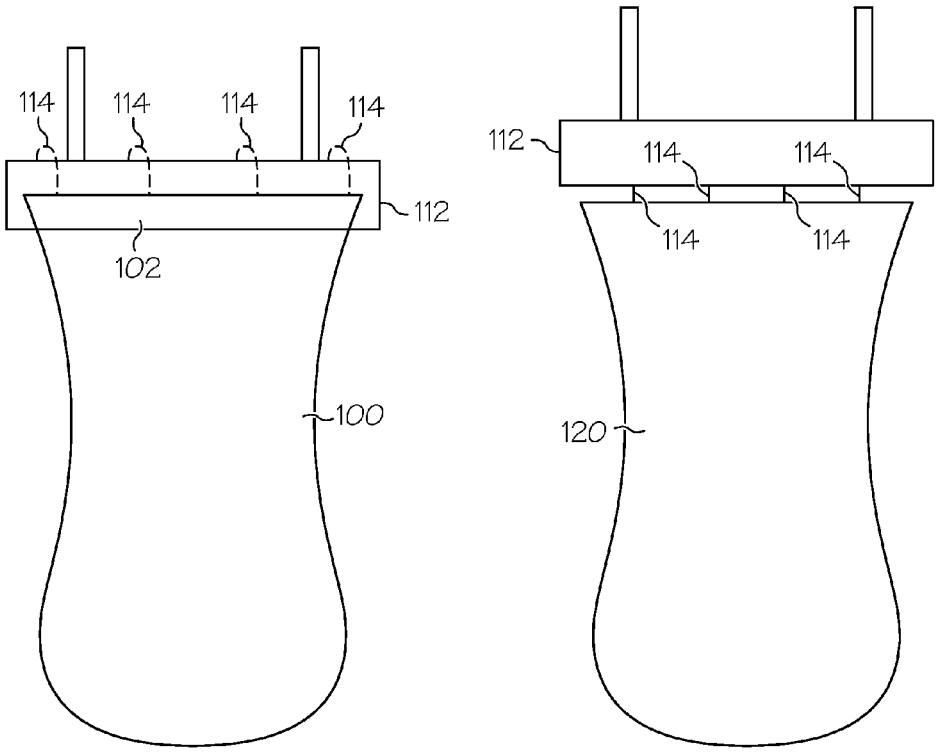
FIG. 37 shows back views of body shapers and bras with universal attachment/connection mechanisms according to an embodiment of the present invention.

FIG. 37 shows back views of body shapers 100 (with high back 102) and 120 (a traditional body shaper) and bras 112 with universal attachment/connection mechanisms 114 according to an embodiment of the present invention. Universal attachment/connection mechanisms 114 couple a body shaper to a bra 112 along any section of the bra band, including, but not limited to: near the back of the bra band, under the arm, and near the cup of the bra. Mechanism 114 may have several positions along the band of bra 112 and may be temporarily detachable from body shapers and bras so that these garments may be worn without being joined by the attachment mechanism. In the union of high back body shaper 100 and bra 112 mechanism 114 is concealed by the overlap of high back 102 and the band of the bra, whereas in the union of regular body shaper 120 and bra 112 mechanism 114 is concealed beneath the gapless joining of the lower rim of bra 112 and the upper edge of body shaper 120. Regardless, mechanisms of attachment 114 will be substantially non-viewable. For example, overlaying layers of fabric or another attachment mechanism causing the attachment of a body shaper to a bra in a gapless fashion are utilized to conceal both methods of attachment and undesired bumps in the body shaper. Additionally, attachment mechanisms 114 are positioned to fall in line with traditional placement of existing bra straps so that no additional lines are present and for ease of attachment.

Figure 38:
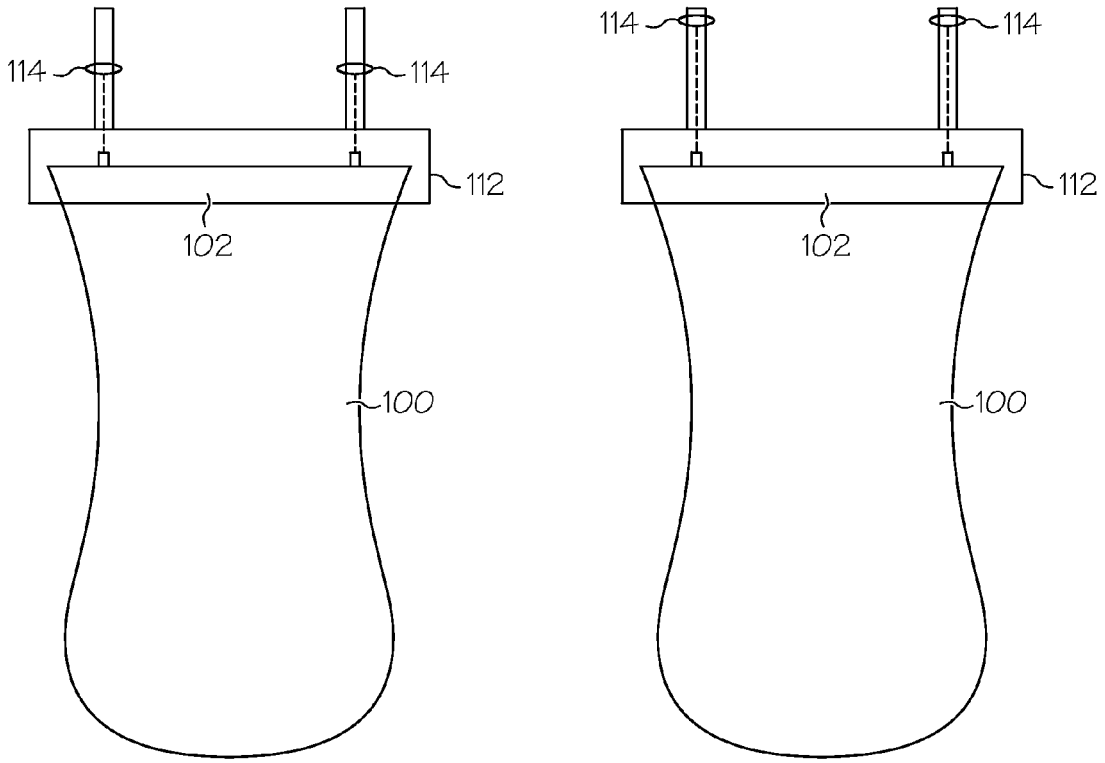
FIG. 38 shows back views of high back body shapers and bras with universal attachment/connection mechanisms to the bra straps according to an embodiment of the present invention.

FIG. 38 shows back views of high back body shapers 100 and bras 112 with universal attachment/connection mechanisms 114 to the bra straps according to an embodiment of the present invention. While some embodiments of mechanisms of universal attachment/connection of body shaper 100 to bra 112 connect the back band of bra 112 to body shaper 100, body shaper 100 can also be coupled to bra 112 via attachment along the shoulder straps of the bra. As shown in FIG. 38, universal attachment/connection mechanisms 114 may attach anywhere along the shoulder strap, such as, but not limited to: near the back intersection of the bra band and shoulder strap or near the apex of shoulder strap arch. Although not shown in FIG. 38, attachment/connection mechanisms 114 could also couple body shaper 100 to the straps of bra 112 in the front of the bra.

Figure 39:
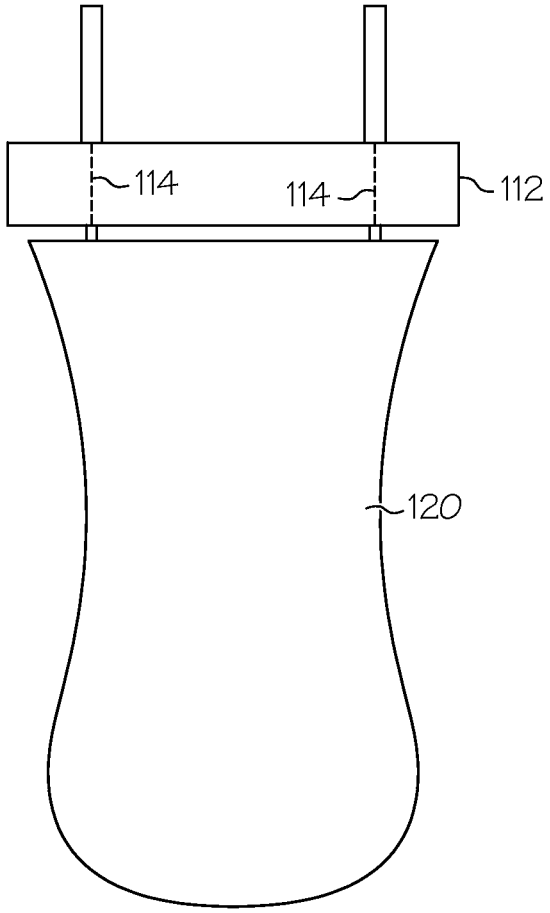
FIG. 39 shows a back view of a regular back body shaper and bra with a universal attachment/connection mechanism according to an embodiment of the present invention.

FIG. 39 shows a back view of a regular back body shaper 120 and bra 112 with a universal attachment/connection mechanism 114 according to an embodiment of the present invention. Regular back body shaper 120 is "traditional," having a front and back of the same height. The universal attachment/connection mechanism 114 associated with regular body shaper 120 may be of specific or adjustable length so as to allow the top rim of body shaper 120 to sit gaplessly against the bottom rim of bra 112. Universal attachment/connection mechanism 114 may connect, in some embodiments of the invention, with any set of locations along the band and the straps of bra 112. Universal attachment/connection mechanism 114 is discreetly concealed so as to minimize discomfort to the wearer and maximize ascetic appearance.

Figure 40:
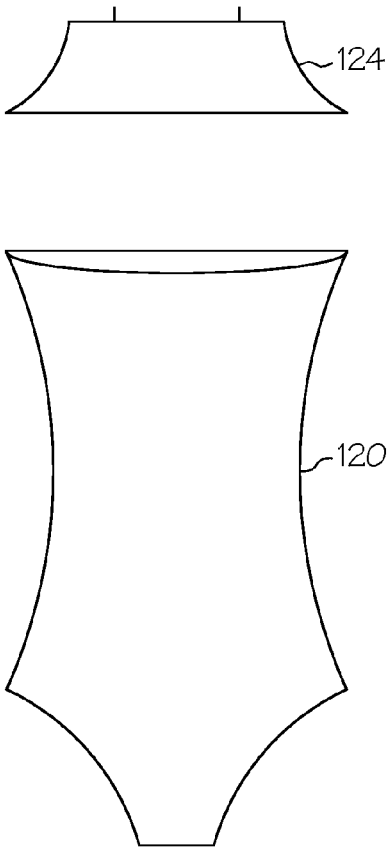
FIG. 40 shows a front view of a high back attachment for a regular back body shaper and a regular back body shaper according to an embodiment of the present invention.
Figure 41:
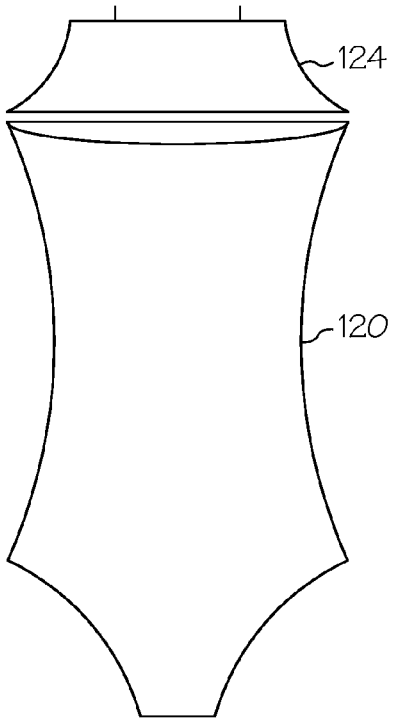
FIG. 41 shows a front view of the high back attachment for a regular back body shaper and the regular back body shaper of FIG. 40 joined together according to an embodiment of the present invention.

FIG. 40 shows a front view of a high back attachment 124 for a regular back body shaper and a regular back body shaper 120 according to an embodiment of the present invention. High back attachment 124 can be seamlessly and gaplessly joined to the back of any regular back body shaper, as seen in FIG. 41, using one or more universal attachment/connection mechanisms. Traditionally, a regular back body shaper is the same height in the front and back. High back attachment 124 performs the same function as high back 102 (FIG. 22), joining to a bra via a universal attachment/connection mechanism to form a gapless union between the bra and the high back. High back attachment 124, however, may be attached, detached, and used in conjunction with any regular body shaper. The attachment mechanisms employed by high back attachment 124 at both the high back attachment to body shaper interface and the high back attachment to bra interface may include, but are not limited to: adhesives, Velcro, hooks and eyes, clips, buttons, snaps, straps, no-slip materials, and combinations thereof. The high back attachment to bra interface may include, but are not limited to, connection locations discussed hereinabove, such as at the bra band, the bra straps, and the sides of the bra. The high back attachment may also additionally comprise high sides, or other similar variations on embodiments of the invention discussed above such as are within the spirit of the invention.

Figure 42:
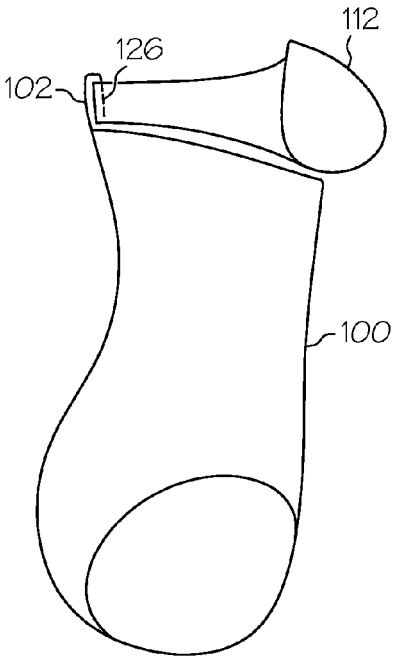
FIG. 42 shows a side view of a high back body shaper with a fold over edge tucked over a band of a bra according to an embodiment of the present invention.

FIG. 42 shows a side view of a high back body shaper 100 with a fold over edge 126 tucked over a band of a bra 112 according to an embodiment of the present invention. Various attachment/connection mechanisms, including adhesives, Velcro, hooks and eyes, clips, buttons, snaps, straps, and combinations thereof, have been discussed hereinabove. Fold over edge 126 provides an additional mechanism of attachment. High back 102 of high back body shaper 100 is extended to form fold over edge 126. Fold over edge 126 folds over the back of the band of bra 112. Fold over edge 126 is held in place when body shaper 100 and bra 112 are worn in combination by being tightly tucked between the back of the wearer and the inner side of the band of bra 112. The tucking in place of fold over edge 126 prevents high back body shaper 100 from slipping downward while also forming a seamless and gapless union of the bra and body shaper, such that no bumps, lines, or other signs of connection are noticeably visible. Additional embodiments of the invention that comprise a fold over edge may also be envisioned in light of embodiments of the present invention discussed hereinabove. For example, a body shaper may have high sides which extend into fold over edges, or flaps, on the left and right side of the body shaper. These high side fold over edges would be folded over the sides of a bra band and tucked between the wearer's sides and the bra band, under a wearer's arms. Methods of intersecting and arranging the materials of the bra and high back body shaper, including variations of the embodiment discussed above, so as to form a seamless attachment mechanism are within the spirit of the invention.

Figure 43:
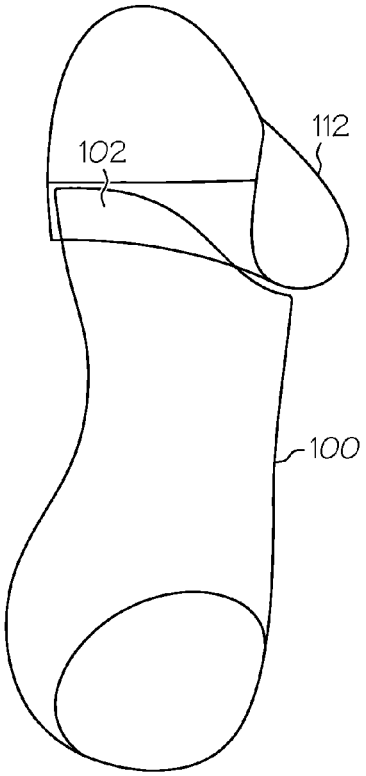
FIG. 43 shows a side view of a high back body shaper with high back tucked under a bra according to an embodiment of the present invention.

FIG. 43 shows a side view of a high back body shaper 100 with high back 102 tucked under a bra 112 according to an embodiment of the present invention. High back 102 of high back body shaper 100 may also be used as an anchor attachment mechanism to hold high back body shaper in place on a wearer and prevent the body shaper from slipping down the back of the wearer. High back 102 protrudes above the top edge of body shaper 100, the front and sides of the shaper ending at the base of bra 112, according to traditional designs. However, high back 102 rises above the base of the bra, crossing behind and tucking behind the band of bra 112. Held between the back of the wearer and the band of bra 112, high back 102 is secured in place, thereby securing high back body shaper 100 in place as well. The high anchor attachment mechanism may also additionally comprise high sides, or other similar variations on embodiments of the invention discussed above such as are within the spirit of the invention.

It is noted that all versions of the bra(s) or body shaper(s) discussed herein can have the following:

- None, one, or more than one bra strap.
- Underwire built into the cups or underwire built into the band, or no underwire at all.
- The band of this bra can also have one or more traditional hook and eye back closure.
- The bridge between the two cups can be made of any material, or connected by any process, connection mechanism, technique, or style now known within the industry or later developed.
- The center bridge connection mechanism can be located anywhere along the edge of the bra cups.
- The band of this bra can be any length (e.g., 1" to 36" long). The band width size can be any width (e.g., 1" to 36" wide). The band can also vary in width size on the same band. For example, starting at one end being wider and the other end being more narrow. Alternatively, each end of band can be wider than a middle portion of the band. Or any combination thereof.
- The cups and band of this bra can be made of any material or combination of material now known or later developed.
- The band connection mechanisms can be: surface mount connector, partially recessed/partially protruding connector, fully recessed connector, recessed flush mount connector, or any combination thereof. For example: the band can be fitted with a part recessed/part protruding connection mechanism, and the cup to which it will connect may have a fully recessed connection mechanism.

Optional crotch flap or crotch gusset, crotch snap, crotch hook, etc.

The foregoing description of various aspects of the invention has been presented for purposes of illustration and description. It is not intended to be exhaustive or to limit the invention to the precise form disclosed and, obviously, many modifications and variations are possible. Such modifications and variations that may be apparent to a person skilled in the art are intended to be included within the scope of the invention as defined by the accompanying claims.

What is claimed is:

1. An undergarment for use with a brassiere having a pair of cups and a back band extending substantially horizontally from respective outer sides of the cups about the back of a user, the undergarment comprising:

a unitary body piece having an inside, an outside, a front, a back, opposing sides, a top portion and a bottom portion, each defined by their relative positions when worn by the user; and at least one fastener adjacent the top portion of the back of the body piece, the fastener operable to removably engage the brassiere adjacent the back band such that the back of the user is not visible between the back band and the top portion;

wherein the back of the body piece extends higher than the front of the body piece, and the front of the body piece extends proximate to a lower portion of the brassiere cups;

wherein the body piece is only coupled to the brassiere via the at least one fastener; and wherein the unitary body piece is shapewear for compressing the user's body therein.

2. The undergarment of claim 1, wherein the brassiere back band at least partially covers the top portion of the body piece.

3. The undergarment of claim 1, wherein the fastener is operable to removably engage one or more straps of the brassiere.

4. The undergarment of claim 1, wherein the fastener is removably affixed to the top portion of the body piece.

5. The undergarment of claim 1, further comprising a plurality of fasteners.

6. The undergarment of claim 1, wherein the fastener comprises at least one of the following types: hook-and-loop, button, snap, clip, hook and adhesive.

7. The undergarment of claim 2, wherein the fastener consists of silicone friction material interposed between the top portion of the body piece and the back band.

* * * * *